US011140488B2

(12) United States Patent
Nevill et al.

(10) Patent No.: US 11,140,488 B2
(45) Date of Patent: Oct. 5, 2021

(54) SPEAKER-DRIVER CONE WITH INCREASED STIFFNESS

(71) Applicants: Stuart Nevill, Menlo Park, CA (US); Ian Bickers, Worthing (GB)

(72) Inventors: Stuart Nevill, Menlo Park, CA (US); Ian Bickers, Worthing (GB)

(73) Assignee: B&W Group Ltd., Worthing (GB)

( * ) Notice: Subject to any disclaimer, the term of this patent is extended or adjusted under 35 U.S.C. 154(b) by 0 days.

(21) Appl. No.: 16/416,189

(22) Filed: May 18, 2019

(65) Prior Publication Data

US 2019/0364365 A1 Nov. 28, 2019

Related U.S. Application Data

(60) Provisional application No. 62/674,825, filed on May 22, 2018.

(51) Int. Cl.
*H04R 7/14* (2006.01)
*H04R 7/12* (2006.01)
(Continued)

(52) U.S. Cl.
CPC ..... *H04R 7/14* (2013.01); *H04R 1/025* (2013.01); *H04R 7/127* (2013.01); *H04R 31/003* (2013.01); *H04R 2499/15* (2013.01)

(58) Field of Classification Search
CPC . H04R 7/14; H04R 7/12; H04R 7/122; H04R 7/125; H04R 7/127; H04R 1/025; H04R 2400/11; H04R 9/04
(Continued)

(56) References Cited

U.S. PATENT DOCUMENTS 5,862,242 A * 1/1999 Takewa ..... H04R 9/02 381/396
7,416,047 B2 * 8/2008 Frasl ..... H04R 7/14 181/173
(Continued)

FOREIGN PATENT DOCUMENTS

CN 106559727 4/2017
DE 1004232 3/1957
JP 59165596 A * 9/1984 ..... H04R 7/10

OTHER PUBLICATIONS

Extended European Search Report, European Patent Application No. 19176050.3-1207, dated Oct. 9, 2019.
(Continued)

*Primary Examiner* — James K Mooney
(74) *Attorney, Agent, or Firm* — Peter A. Nieves; Sheehan Phinney Bass & Green PA

(57) ABSTRACT

A diaphragm for use is a loudspeaker is described. This diaphragm may include a housing with an elongated shape having a length along a first axis that is longer than a width along a second axis. Moreover, the housing may include: an outer surface and an inner surface; an outer opening defined by an outer edge and an inner opening defined by an inner edge; and regions having heights relative to the inner surface, where the regions are grouped in pairs that are positioned equidistant and symmetrically about the inner opening along the first axis. Furthermore, the regions may have a second length along the first axis, and the second length may be less than a distance along the first axis between the outer edge and the inner edge. Note that the regions may increase a stiffness of the diaphragm relative to a stiffness of a material in the diaphragm.

23 Claims, 6 Drawing Sheets

(51) Int. Cl.
*H04R 1/02* (2006.01)
*H04R 31/00* (2006.01)

(58) Field of Classification Search
USPC ..... 381/433, 368, 398, 423
See application file for complete search history.

(56) References Cited

U.S. PATENT DOCUMENTS

2007/0189571 A1* 8/2007 Corynew ..... H04R 7/14
381/396
2008/0232633 A1* 9/2008 Corynen ..... H04R 7/14
381/396
2013/0070956 A1* 3/2013 Yamanaka ..... H04R 1/025
381/433

OTHER PUBLICATIONS

Machine translation of CN 106559727.
Machine translation of DE 1004232.

* cited by examiner

SPEAKER-DRIVER CONE WITH INCREASED STIFFNESS

CROSS REFERENCE TO RELATED APPLICATIONS

This application claims priority under 35 U.S.C. 119(e) to U.S. Provisional Application Ser. No. 62/674,825, "Asymmetric Speaker-Driver Cone with Increased Stiffness," filed on May 22, 2018, the contents of which are herein incorporated by reference.

FIELD

The present disclosure relates to improvements in and relating to loudspeakers and headphones. More particularly, this disclosure concerns the coupling of sound from a loudspeaker or a headphone using a diaphragm having an improved bending mode. The invention also concerns an improved diaphragm for use with a loudspeaker or a headphone, an enclosure comprising such a diaphragm, a drive unit and a chassis assembly, and a method of manufacturing such a diaphragm for a loudspeaker or a headphone.

BACKGROUND

A loudspeaker drive unit typically includes a diaphragm (also known as a 'cone'), a chassis (also known as a basket or frame), a voice coil and a driver magnet. The diaphragm is typically attached to the chassis via a flexible suspension of some sort. For example, the diaphragm may be attached to the chassis by a two-part suspension that includes: a spider, typically a corrugated disk of flexible material which joins the center of the diaphragm/voice-coil to the chassis; and a surround, typically a ring of flexible material which joins the outer circumference of the diaphragm to the chassis. The voice coil is typically attached to the diaphragm so that in use an electrical current is applied to the voice coil generating an electromagnetic field that interacts with the magnetic field of the driver magnet thereby causing the voice coil and consequently the diaphragm to move.

In order to maintain sound quality in use, when the drive unit is installed in a loudspeaker enclosure such as a loudspeaker cabinet, it is desirable for the drive unit to produce controlled vibration in the diaphragm whilst minimising, or otherwise controlling, unwanted vibration in the other elements of the loudspeaker drive unit and enclosure.

For example, in some applications sound output by the drive unit is steered or focused using a diaphragm. However, the vibration of the drive unit can excite a bending mode of the diaphragm. The resulting continued vibration of the diaphragm, independent of the applied input signal, can radiate unwanted sound that leads to 'time-smearing' (a form of coloration) or otherwise distorting the acoustic response of the loudspeaker. Thus, the vibration of the diaphragm can degrade the accurate reproduction of the sound from the input signal.

SUMMARY

A diaphragm for use in a loudspeaker is described. This diaphragm may have a housing with an elongated (or asymmetric) shape having a length along a first axis that is longer than a width along a second axis. Moreover, the housing may include an outer surface and an inner surface. Furthermore, the housing may include an outer opening defined by an outer edge and an inner opening defined by an inner edge. Additionally, the housing may include regions having heights relative to the inner surface, where the regions are grouped in pairs that are positioned equidistant and symmetrically about the inner opening along the first axis. Note that the regions may each have a second length along the first axis, and the second length may be less than a distance along the first axis between the outer edge and the inner edge.

Moreover, the heights of the regions may be raised, depressed or dimpled relative to the inner surface. In some embodiments, the regions include embossed regions.

Furthermore, a thickness of the regions may be the same as a thickness of the housing outside of the regions.

Additionally, the inner edge may be configured to couple to a drive unit.

In some embodiments, the regions protrude from the inner surface towards a central axis of the diaphragm that is perpendicular to the inner opening and is parallel to a symmetry axis of the inner opening. Moreover, the inner surface may be at an angle relative to the central axis, where the angle is between 0 and 90°.

Note that there may be two raised regions having tear drop shape or propeller shapes. The tear drop shape may have an inner radius and an outer radius, where the inner radius is less than the outer radius. Furthermore, the diaphragm may have a race-track shape.

Additionally, the heights of the regions may vary along the second axis. In some embodiments, the variation of the heights of the regions along the second axis corresponds to a depth radius along the second axis.

Note that the regions may increase a stiffness of the diaphragm relative to a stiffness of a material in the diaphragm.

Another embodiment provides a loudspeaker that includes the diaphragm.

Another embodiment provides a headphone that includes the diaphragm.

Another embodiment provides an electronic device that includes a loudspeaker that includes the diaphragm.

Another embodiment provides a method for fabricating the diaphragm.

This Summary is only provided for purposes of illustrating some exemplary embodiments, so as to provide a basic understanding of some aspects of the subject matter described herein. Accordingly, it will be appreciated that the above-described features are only examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DESCRIPTION

Figure 1A:
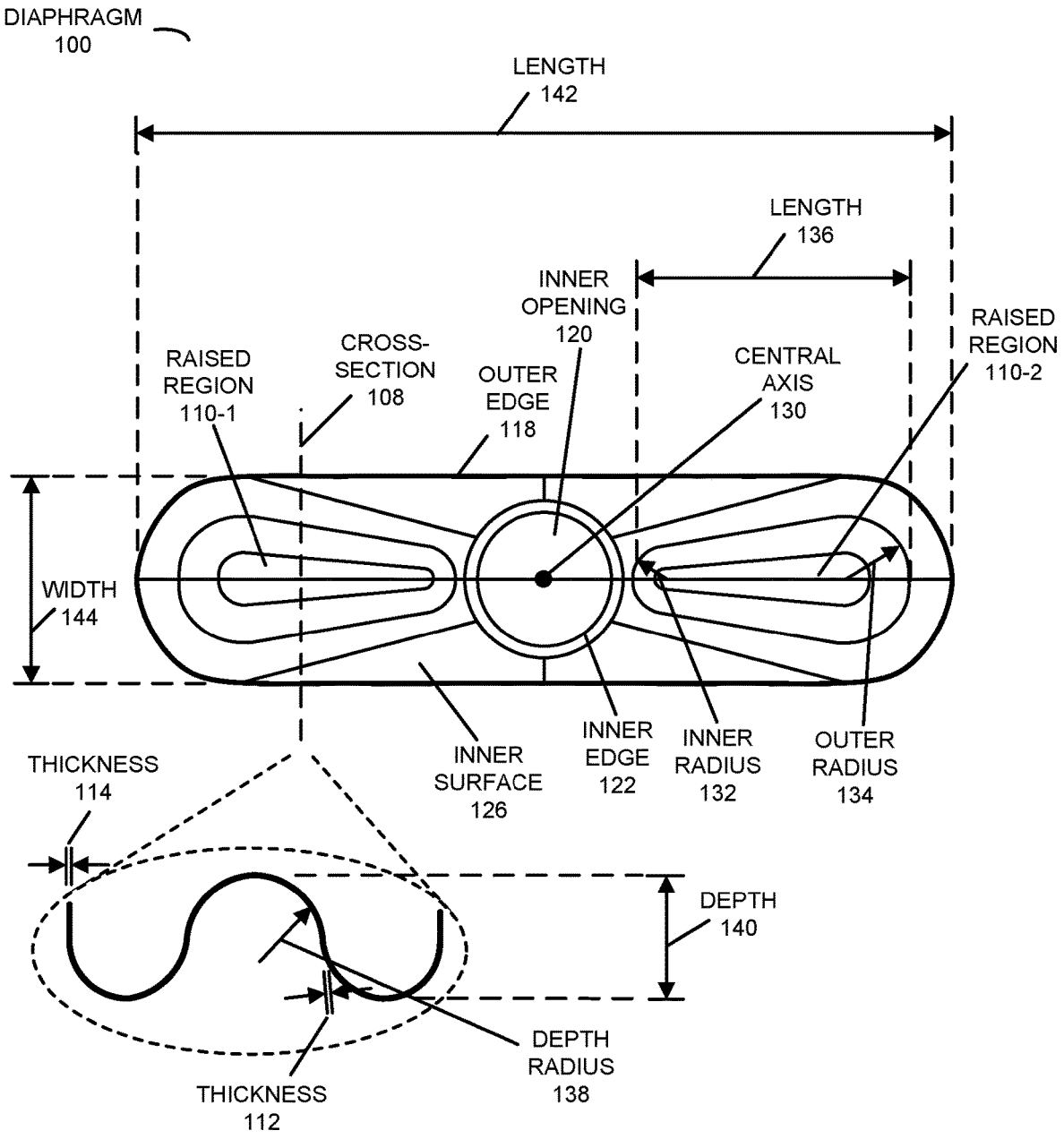
FIG. 1A is a top view illustrating an example of a diaphragm in accordance with an embodiment of the present disclosure.
Figure 1B:
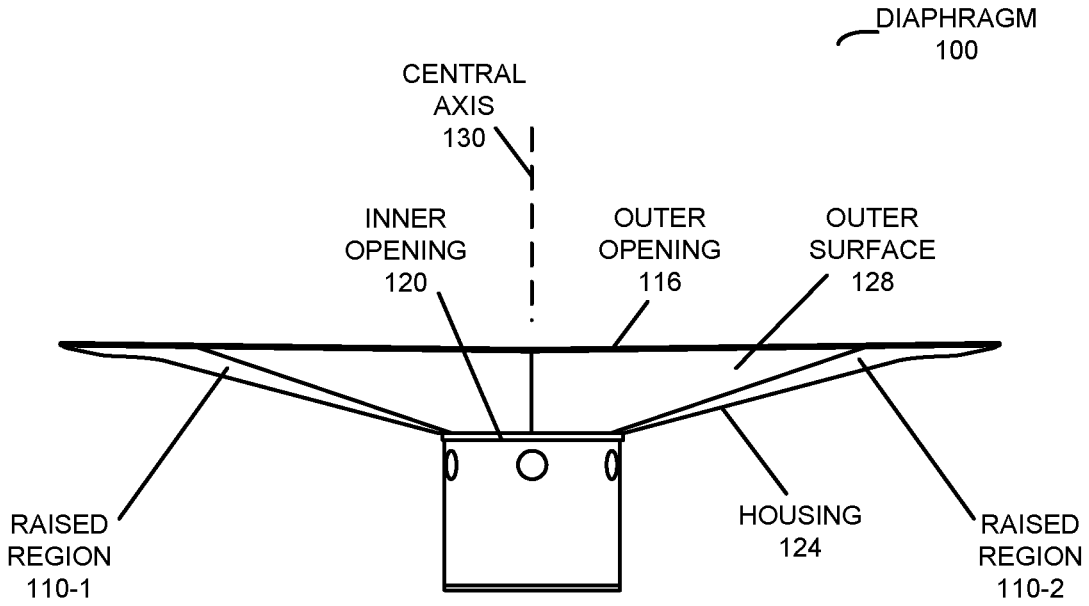
FIG. 1B is a side view illustrating an example of a diaphragm in accordance with an embodiment of the present disclosure.
Figure 1C:
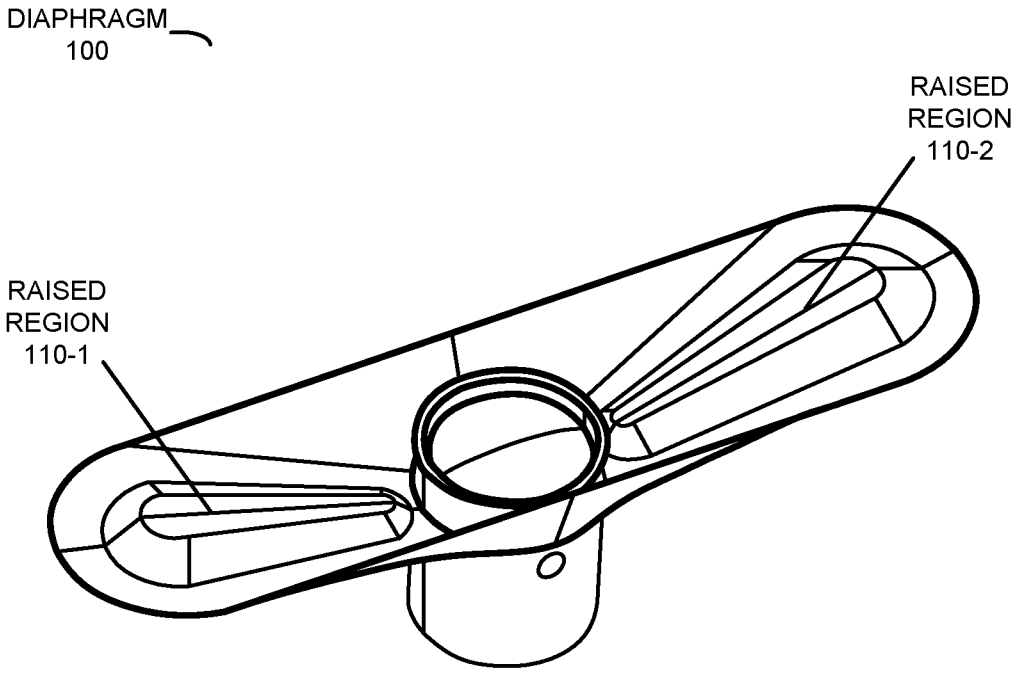
FIG. 1C is a perspective view illustrating an example of a diaphragm in accordance with an embodiment of the present disclosure.
Figure 1D:
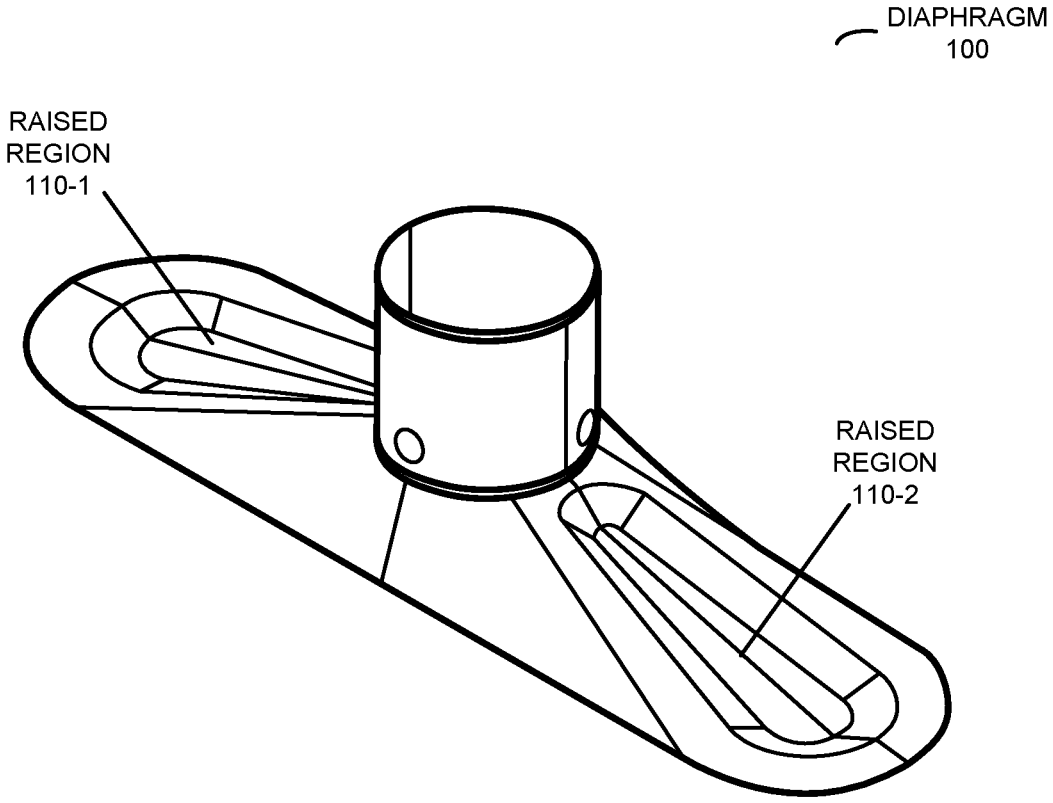
FIG. 1D is a perspective view illustrating an example of a diaphragm in accordance with an embodiment of the present disclosure.

A diaphragm for use is a loudspeaker is described. This diaphragm may include a housing with an elongated shape having a length along a first axis that is longer than a width along a second axis. Moreover, the housing may include: an outer surface and an inner surface; an outer opening defined by an outer edge and an inner opening defined by an inner edge; and regions having heights relative to the inner surface, where the regions are grouped in pairs that are positioned equidistant and symmetrically about the inner opening along the first axis. Furthermore, the regions may each have a second length along the first axis, and the second length may be less than a distance along the first axis between the outer edge and the inner edge.

The regions in the diaphragm may increase a stiffness of the diaphragm relative to that of the material of the diaphragm even though the diaphragm has an asymmetric shape. This configuration may reduce unwanted vibrations of the diaphragm (which are independent of an applied input or drive signal) and, thus, may maintain the performance of a loudspeaker that includes the diaphragm (such as the accurate reproduction of the sound from the input signal).

FIGS. 1A-1D present different perspective views of an example of a diaphragm 100 according to some embodiments. Diaphragm 100 may include one or more raised, depressed or dimpled and, more generally, embossed regions 110. In the discussion that follows, these one or more features are referred to as one or more 'raised regions' 110. The one or more raised region 110 may have a thickness 112 that is substantially the same as a thickness 114 of a remainder of diaphragm 100. In some embodiments, thickness 112 of the one or more raised regions 110 is the same as thickness 114 of the remainder of diaphragm 100. Moreover, diaphragm 100 may have an outer opening 116 defined by an outer edge 118, an inner opening 120 defined by an inner edge 122.

Figure 2:
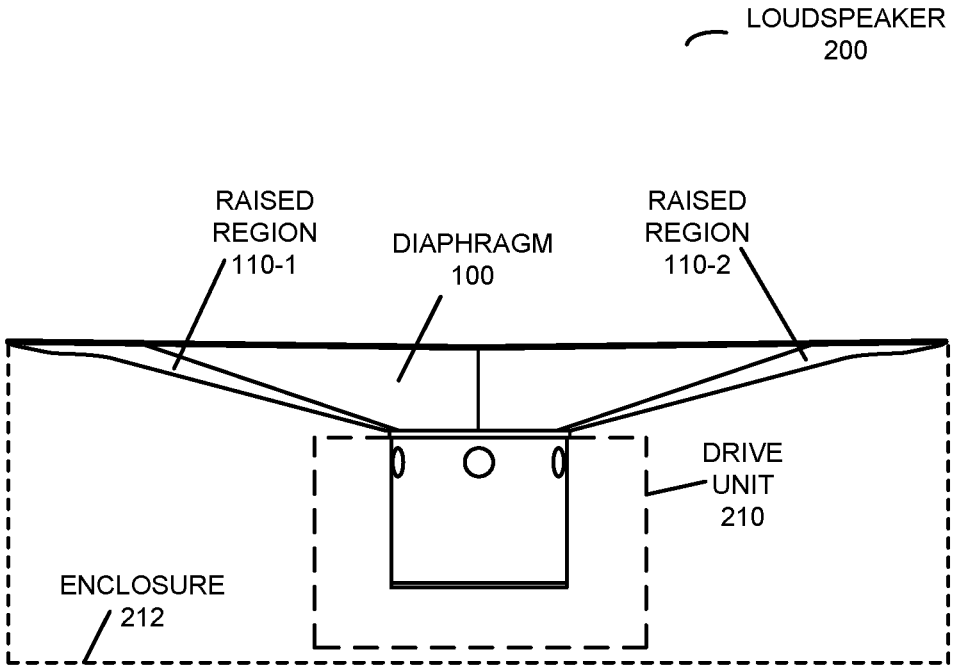
FIG. 2 is a side view illustrating an example of a loudspeaker in accordance with an embodiment of the present disclosure.

FIG. 2 presents a side view of an example of a loudspeaker 200 according to some embodiments. This loudspeaker may include diaphragm 100. Alternatively, in some embodiments diaphragm 100 may be included in a headphone.

During operation of loudspeaker 200 (or a headphone), inner edge 122 (FIG. 1) may be positioned proximate to one or more drive units (such as drive unit 210), while outer edge 118 may be distal from the one or more drive units 210). Moreover, loudspeaker 200 may have an enclosure 212.

Referring back to FIGS. 1A-1D, diaphragm 100 may have a wall or housing 124 having an inner surface 126 and an outer surface 128. The one or more raised regions 110 may protrude from inner surface 126 towards a central axis 130 of diaphragm 100 (which may be perpendicular to inner opening 120 and may be parallel to a symmetry axis of inner opening 120).

For example, diaphragm 100 may include two raised regions 110 that are positioned equidistance and symmetrically about central axis 130, such as a 'race-track shaped' (or elongated shaped) diaphragm with two 'propeller shaped' raised regions 110.

Furthermore, a given raised region (such as raised region 110-1) may have approximately a 'tear drop' shape. An inner radius 132 of the tear drop may be, e.g., 3.0 mm, while an outer radius 134 of the tear drop may be 5.5 mm. Additionally, a length 136 of the tear drop may be 19.0 mm, and a thickness 112 of diaphragm 100 may be 0.15 mm. In some embodiments, a given raised region may have a depth radius 138 along the second axis (i.e., when viewed along a perpendicular cross-section 108 of the given raised region, which is shown in the inset in FIG. 1A) of, e.g., 10.0 mm and a peak or maximum depth 140 of, e.g., 3.0 mm. However, these numerical values are for exemplary purposes, and other numerical values may be used. For example, one or more geometric lengths associated with the one or more raised regions 110 may be scaled with a size of diaphragm 100, and a number of raised regions 110 may be determined by a shape of diaphragm 100. For a given size and shape of diaphragm 100, the numerical values (such as those provided herein) may be varied by ±10-33%. More generally, a wide variety of numerical values may be used.

Diaphragm 100 with the one or more raised regions 110 may be used with diaphragm geometries that are other than circular or symmetric about central axis 130. For example, diaphragm 100 may have a length 142 of 75.0 mm, a width 144 of 19.0 mm and a thickness 114 of 0.15 mm. This geometry may be used with a rectangular midrange loudspeaker. In these non-circular embodiments, diaphragm 100 may not have or may lose the hoop stiffness associated with a circular shape or geometry. Instead, such non-circular shapes or geometries may rely on the static stiffness of the material(s) in diaphragm 100. Consequently, in these embodiments, the one or more raised regions 110 may increase the stiffness of diaphragm 100 (such as a bending stiffness).

Note that diaphragm 100 may be fabricated using a variety of materials, such as: paper, aramid (aromatic polyamide) fiber (e.g., Kevlar), glass fiber, fiber glass, carbon fiber (e.g., woven carbon fiber), resin-infused or impregnated fiber, woven fiber, quartz fiber, glass, diamond, diamond SP3, a polymer, plastic, a metal, aluminium oxide, boron carbide, and/or a material having similar mechanical properties to one or more of the preceding materials. Moreover, diaphragm 100 may be fabricated using a one or more processing techniques, including: evaporation, sputtering, chemical vapor deposition, molecular-beam epitaxy, wet or dry etching (such as photolithography or direct-write lithography), polishing, embossing or stamping, etc.

Furthermore, diaphragm 100 may have a monolithic or a composite construction (such as one held together with a stiffening adhesive, e.g., a polyvinyl acetate adhesive).

Note that the one or more raised regions 110 in diaphragm 100 may increase the fundamental frequency of a bending or 'bird flapping' mode from, e.g., 550 Hz to 720 Hz.

Diaphragm 100 may be used in a variety of applications, such as: home stereo, in vehicle, in a wall, in a consumer-electronic device (such as a television or a display), a headphone, a desktop computer, a laptop computer, a tablet computer, a smartphone, a cellular telephone, a smartwatch, a portable computing device, a camera, a wearable appliance, and/or another electronic device.

Figure 3:
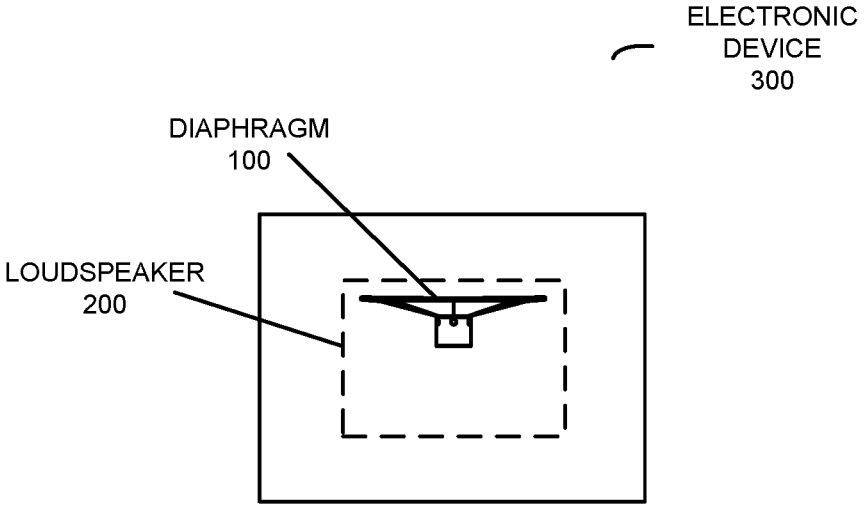
FIG. 3 is a block diagram illustrating an example of an electronic device in accordance with an embodiment of the present disclosure.

FIG. 3 presents a block diagram illustrating an example of an electronic device 300 according to some embodiments. This electronic device may include loudspeaker 200 with diaphragm 100. As noted previously, electronic device 300 may include: a consumer-electronic device (such as a television or a display), a headphone, etc.

Other embodiments provide a method for fabricating a diaphragm, such as diaphragm 100 in FIGS. 1A-1D and 2.

In the preceding description, we refer to 'some embodiments.' Note that 'some embodiments' describes a subset of all of the possible embodiments, but does not always specify the same subset of embodiments. Moreover, note that the numerical values provided are intended as illustrations of the embodiments. In other embodiments, the numerical values can be modified or changed.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. A diaphragm configured for use is a loudspeaker, comprising:

a body with an elongated shape having a length along a first axis that is longer than a width along a second axis, wherein the body comprises:

an outer surface and an inner surface;

an outer opening defined by an outer edge and an inner opening defined by an inner edge; and regions which are grouped in pairs that are positioned equidistant and symmetrically about the inner opening along the first axis, wherein each of the regions has a height relative to the inner surface and comprises an outer portion bounded by an outer curved region comprising an outer radius and an inner portion bounded by an inner curved region comprising an inner radius, the outer radius being spaced apart from the outer edge of the diaphragm and the inner radius being spaced apart from the inner edge of the diaphragm, and wherein the regions each have a second length along the first axis, and the second length is less than a distance along the first axis between the outer edge and the inner edge.

2. The diaphragm of claim 1, wherein the heights of the regions comprise one of: raised, depressed or dimpled relative to the inner surface.

3. The diaphragm of claim 1, wherein the regions comprise embossed regions.

4. The diaphragm of claim 1, wherein a thickness of the regions is the same as a thickness of the body outside of the regions.

5. The diaphragm of claim 1, wherein the inner edge is configured to couple to a drive unit associated with the loudspeaker.

6. The diaphragm of claim 1, wherein the regions protrude from the inner surface towards a central axis of the diaphragm that is perpendicular to the inner opening and is parallel to a symmetry axis of the inner opening.

7. The diaphragm of claim 1, wherein the inner surface is at an angle relative to the central axis; and where the angle is between 0 and 90°.

8. The diaphragm of claim 1, wherein the diaphragm comprises two raised regions having tear drop shape or propeller shapes.

9. The diaphragm of claim 8, wherein the tear drop shape has the inner radius and the outer radius; and wherein the inner radius is less than the outer radius.

10. The diaphragm of claim 1, wherein the diaphragm comprises a race-track shape.

11. The diaphragm of claim 1, wherein the heights of the regions vary along the second axis.

12. The diaphragm of claim 11, wherein the variation of the heights of the regions along the second axis corresponds to a depth radius along the second axis.

13. The diaphragm of claim 1, wherein the regions are configured to increase a stiffness of the diaphragm relative to a stiffness of a material in the diaphragm.

14. The diaphragm of claim 1, wherein the second length is greater than 20% of the body length along the first axis.

15. A loudspeaker, comprising a diaphragm, wherein the diaphragm comprises:

a body with an elongated shape having a length along a first axis that is longer than a width along a second axis, wherein the body comprises:

an outer surface and an inner surface;

an outer opening defined by an outer edge and an inner opening defined by an inner edge; and regions which are grouped in pairs that are positioned equidistant and symmetrically about the inner opening along the first axis, wherein each of the regions has a height relative to the inner surface and comprises an outer portion bounded by an outer curved region comprising an outer radius and an inner portion bounded by an inner curved region comprising an inner radius, the outer radius being spaced apart from the outer edge of the diaphragm and the inner radius being spaced apart from the inner edge of the diaphragm, and wherein the regions each have a second length along the first axis, and the second length is less than a distance along the first axis between the outer edge and the inner edge.

16. The loudspeaker of claim 15, wherein the regions comprise embossed regions.

17. The loudspeaker of claim 15, wherein the regions protrude from the inner surface towards a central axis of the diaphragm that is perpendicular to the inner opening and is parallel to a symmetry axis of the inner opening.

18. The loudspeaker of claim 15, wherein the heights of the regions vary along the second axis; and wherein the variation of the heights of the regions along the second axis corresponds to a depth radius along the second axis.

19. The loudspeaker of claim 15, wherein the second length is greater than 20% of the body length along the first axis.

20. An electronic device comprising a loudspeaker, wherein the loudspeaker comprises:

a diaphragm, wherein the diaphragm comprises:

a body with an elongated shape having a length along a first axis that is longer than a width along a second axis, wherein the body comprises:

an outer surface and an inner surface;

an outer opening defined by an outer edge and an inner opening defined by an inner edge; and regions which are grouped in pairs that are positioned equidistant and symmetrically about the inner opening along the first axis, wherein each of the regions has a height relative to the inner surface and comprises an outer portion bounded by an outer curved region comprising an outer radius and an inner portion bounded by an inner curved region comprising an inner radius, the outer radius being spaced apart from the outer edge of the diaphragm and the inner radius being spaced apart from the inner edge of the diaphragm, and wherein the regions each have a second length along the first axis, and the second length is less than a distance along the first axis between the outer edge and the inner edge.

21. The electronic device of claim 20, wherein the electronic device further comprises a display.

22. The electronic device of claim 20, wherein the electronic device comprises a television.

23. The electronic device of claim 20, wherein the second length is greater than 20% of the body length along the first axis.

* * * * *